US005163609A

United States Patent [19]

Muise, Jr.

[11] Patent Number: 5,163,609

[45] Date of Patent: Nov. 17, 1992

[54] PRODUCE CONTAINER

[75] Inventor: H. Donald Muise, Jr., Mira Loma, Calif.

[73] Assignee: Weyerhaeuser Company, Tacoma, Wash.

[21] Appl. No.: 722,758

[22] Filed: Jun. 27, 1991

[51] Int. Cl.[5] ..... B65D 5/30

[52] U.S. Cl. ..... 229/113; 229/171; 229/174; 229/178

[58] Field of Search ..... 229/113, 171, 174, 178, 229/DIG. 11

[56] References Cited

U.S. PATENT DOCUMENTS

| | | | |
|---|---|---|---|
| 2,124,335 | 7/1938 | Klein | 229/172 |
| 3,034,697 | 5/1962 | Frankenstein | 229/174 |
| 3,973,723 | 8/1976 | Owens | 229/178 |
| 4,180,200 | 12/1979 | Wickinson, Sr. | 229/171 |
| 4,529,117 | 7/1985 | Brundage | 229/113 |
| 4,537,344 | 8/1985 | Thomas | 229/DIG. 11 |
| 4,883,221 | 11/1989 | Brundage | 229/174 |
| 4,911,355 | 3/1990 | Bannister | 229/DIG. 11 |

FOREIGN PATENT DOCUMENTS

| | | | |
|---|---|---|---|
| 1240041 | 7/1960 | France | 229/178 |
| 1315957 | 12/1962 | France | 229/178 |
| 1540994 | 2/1979 | United Kingdom | 229/DIG.11 |
| 1544817 | 4/1979 | United Kingdom | 229/DIG. 11 |

*Primary Examiner*—Gary E. Elkins

[57] ABSTRACT

A single piece corrugated paperboard blank is cut and scored to provide a field erectable container without the use of any additional elements for locking pieces together. The container is one having inclined side walls so that the produce, such as asparagus or green onions, which is stacked in a vertical orientation may be packaged and held in place during shipment. The bottom of the erected container is larger than the top and an integral opposed strapping arrangement is provided whereby a plurality of flaps or panels are arranged to be folded into an orientation and locked in place to provide a field erected container which has great vertical stacking strength. Sufficient cooling vents are provided as are opposed hand holds. Upstanding stacking tabs are also provided so that one packed container may be stacked atop another and be substantially held in place.

1 Claim, 4 Drawing Sheets

PRODUCE CONTAINER

BACKGROUND OF THE INVENTION

Briefly the present invention relates to a produce container for holding and shipping upstanding product such as asparagus or onions. More particularly, the invention relates to a corrugated paperboard container for such produce items which can be assembled in the field from a unitary blank of paperboard material.

Corrugated paperboard containers are commonly used to pack and ship upstanding produce items such as asparagus and green onions and usually these containers are larger at the bottom than at the top. State of the art corrugated containers are usually comprised of two pieces where the bottom member may be formed from a cut and scored single blank to form a base with upstanding side walls and an open top, while the cover of the container is a telescoping piece that slides over the exterior walls of the bottom piece after the produce is placed within the bottom portion. Oftentimes, these containers are held together using staples or straps for permanent assembly prior to packing in the field. It was found desirable to have a produce container fabricated from a single unitary blank of corrugated paperboard material which could be erected in the field without the necessity of mechanical equipment. In such a case the scored and cut blanks are distributed to field locations where the produce is growing and field workers can conveniently harvest the produce, erect the container in the field using hand assembly and then immediately pack the produce therein while the container is in a partially erected state.

With such a unitary foldable corrugated paperboard blank, necessary designed features should include ease of assembly using the folding and locking features provided while the same time holding the produced so it does not easily fall out. Another extremley important requirement is that the erected container while holding the produce yield good stacking strength and, therefore, good, strong vertical corners are essential. These general types of corrugated paperboard containers are commonly wax saturated for use in chilled water shower cooling system whereby the packed produce is cooled prior to shipment. Such a cooling technique allows the produce to be shipped longer distances and then distributed to retail outlets while retaining its pleasant appearance and freshness.

Another requirement these types of containers have is that they be properly vented so as to allow free circulation of cooling air to the product after packing.

Accordingly, from the foregoing one object of the present invention is to provide a papreboard container suitable for packing upstanding produce or the like.

Another object of this invention is to provide such a paperboard container which can be hand erected in the field from a unitary cut and scored blank.

Yet a further object of the present invention is to provide such a unitary blank where the erection process and packing of the produce eliminates the need for staples or extraneous straps.

Still a further object of this invention is to provide such a single-piece paperboard container which has suitable stacking strength, suitable venting means, and other known requirements for packing and transporting upstanding produce and the like.

These and other objects of the invention will be better understood upon reading the specification to follow in conjunction with the attached drawings.

SUMMARY OF THE INVENTION

Briefly stated, the present invention is practiced in one form by a single unitary corrugated paperboard container blank which is erectable by hand into a tapered carton intended for packing and shipping upstanding produce such as asparagus and green onions. The blank has a bottom wall and two side walls extending outwardly along two bottom side edges. Extending outwardly from the ends of the bottom wall are the tapered end walls each of which has an interior side reinforcing flap attached thereto. Extending outwardly from the upper edge of each side wall is a closure strapping assembly comprised of a plurality of foldable panels two of which extend outwardly from the top side edges of the side walls. Certain strap panel portions have locking tabs on their ends which are adapted to be folded and slipped into apertures located within the bottom wall. Appropriate venting apertures are located throughout the blank. Additional interior supporting panels may be provided which extend outwardly from certain of the strapping panels.

DESCRIPTION OF THE PREFERRED EMBODIMENT

Figure 1:
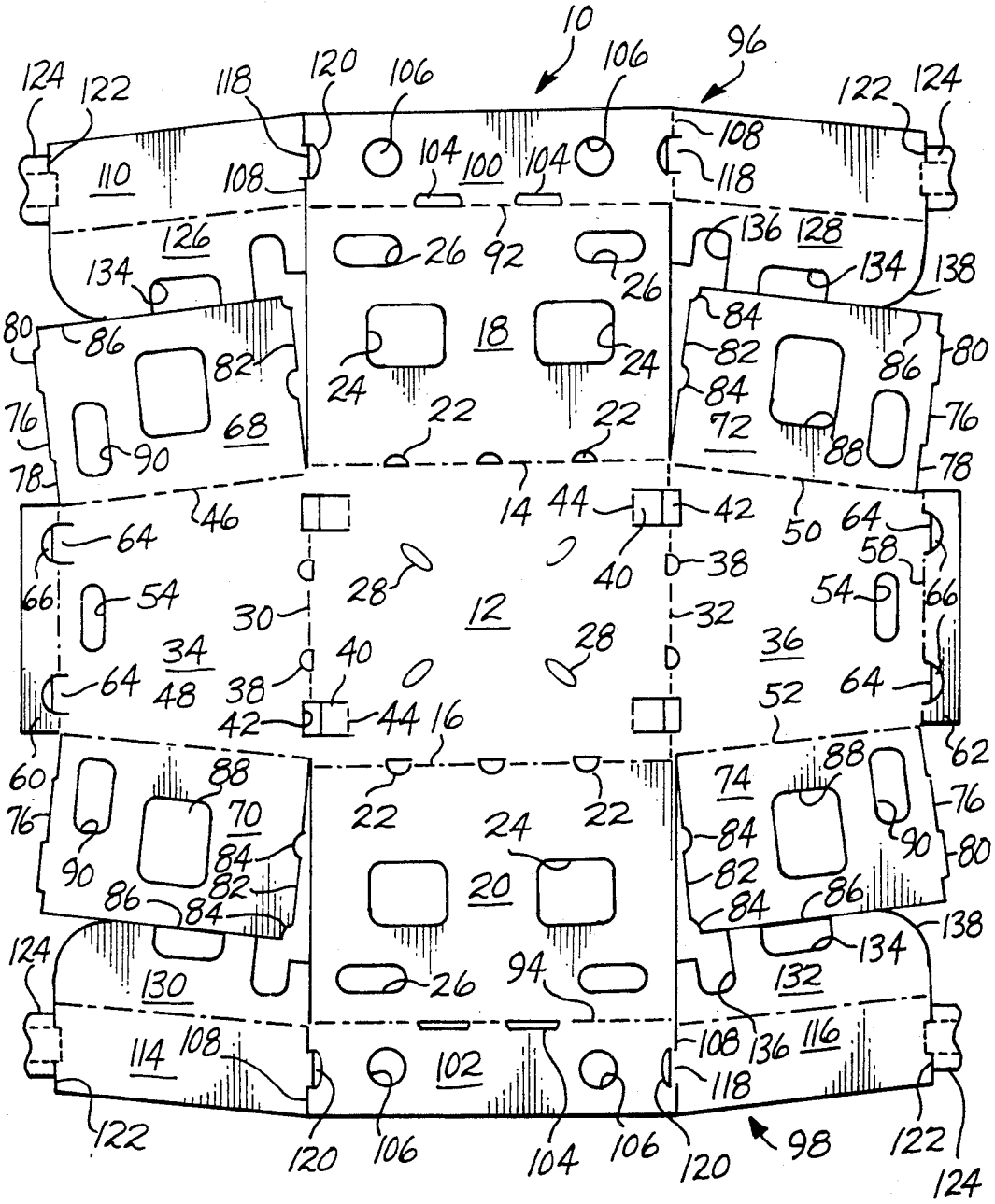
FIG. 1 is a top plan view showing the unitary blank as it will be cut, scored and arranged from a single sheet of typical corrugated paperboard material.

Referring first to FIG. 1, the particular elements of the unitary container blank will be described. First, it is important to point out that the blank illustrated in FIG. 1 is cut and scored from a piece of corrugated paperboard sheet shich is manufactured in the traditional way using typical components for the intended end-use application. A particular application is for the packaging and shipping of upstanding produces such as asparagus and green onions. Typically the paperboard sheet materal will be wax coated for water resistance and will be comprised of relatively heavy component materials in order to produce a strong, durable finished container.

The overall container blank is generally depicted at 10 and as can be seen, is generally rectangular in form. At the central portion of blank 10 is the container bottom wall 12 which has a generally rectangular shape. Extending along opposed sides of bottom wall 12 are score lines 14, 16 and extending outwardly from those score lines are side walls 18, 20. Located along the bottom edge of side walls 18, 20 are three relatively small cooling apertures, each indicated at 22. Each side wall 18, 20 is substantially rectangular in shape an has two opposed relatively large cooling apertures each indicated at 24 and relatively smaller opposed cooling apertures 26.

Located within bottom wall 12 are four spaced relatively small cooling apertures each indicated at 28.

Defining the side edges of bottom wall 12 are opposed score lines 30, 32 and extending outwardly therefrom are the opposed end walls 34, 36. Located substantially within end walls 34, 36 along their bottom edge are relatively small cooling apertures each indicated at 38.

Approximately in the corners of bottom wall 12 there are four spaced tabs each indicated 40 within the bottom wall and opposing the tabs 40 are rectangular cutouts located substantially within the opposed score lines 30, 32 with the cutouts each indicated at 42. As will become apparent, the tabs 40 and cutouts 42 form a part of the container locking means. Each tab 40 is hinged on a hinge line each indicated at 44.

Each end wall 34, 36 has inclined side edges which are opposed hinge lines 46, 48 and 50, 52, respectively. In a typical asparagus container the inclined angle will be approximately 6° from the vertical so that the bottom of the erected container is larger than the top. This will become apparent later. Of course, other angles can be designed into the container blank depending upon the product requirements. As will be noted, each of the end walls 34, 36 will have a trapezoidal shape with a height dimension which will be equal to the depth of the container. Towards the top end within each end wall 34, 36 are hand hold apertures each indicated at 54. Extending outwardly from each top edge along opposd hinge lines 56, 58 are the opposed top end cover panels 60, 62. Panels 60, 62 are relatively narrow and are equal to the width dimension of the top of the container. Positioned and laterally spaced from one another on hinge lines 56, 58 are stacking tabs, each indicated at 64, and opposed cutouts each indicated at 66. Each cover panel 60, 62 will form a top horizontal ledge atop which will overlie a part of the strapping assemblies which will be more fully explained later. Extending outwardly from the respective hinge lines 46, 48 and 50, 52 are opposed patial vertical side walls 68, 70 and 72, 74, respectively. The dimension for each partial vertical side wall is coincident with the dimension of its respective hinge line and will be the vertical height along the incline which each side wall will assume when the container is fully erected. The dimension normal to the respective hinge lines will be approximately equal to one-half of the length dimension of the container and when the container is erected the opposed partial vertical side walls on the same side of the container will be folded inwardly and meet at approximately the center. This may be seen clearly in FIG. 2. Along each top edge 76 of the partial vertical side wall 68, 70 and 72, 74 will be an inner depression each indicated at 78 to receive the respective top end cover panel and an outwardly extending locking tab each indicated at 80 for locking the strapping assemblies in place. Along the bottom edge, generally indicated at 82, of each partial vertical side wall are opposed cutouts each indicated at 84 which when the container is in the erected condition will overlie the small cooling apertures 22. The opposed edges that will meet approximately at the centerlines of the box when in the erected condition are each indicated at 86. Within each wall 68, 70 and 72, 74 are cooling apertures with the apertures indicated at 88 being located to lie concentrically under and of the same dimension as apertures 24. Similarly, apertures 90 are located and sized to underlie the relatively smaller apertures 26 within the side walls.

Turning now to a description of the strapping assembly, there are two opposed strapping assemblies extending outwardly from opposed hinge lines 92, 94 along the top edges of side walls 18, 20. The opposed strapping assemblies are indicated generally at 96, 98, respectively. The first pair of opposed flaps or portions in each strapping assembly are top partial closure flaps 100, 102, respectively. Each flap 100, 102 has a width dimension which is approximately equal to one-third of the width dimension across the top of the erected container. The purpose is to leave an openign across the top of the container which is approximately one-third of the total width dimension. This may be seen when referring to FIG. 4. Within each opposed top closure flap 100, 102 are laterally spaced rectangular slots each indicated at 104 within which the locking tabs 80 will fit when the container is erected. In addition, each closure flap 100, 102 has a pair of spaced circular apertures each indicated at 106 which provide additional cooling openings for the packaged produce.

Along each short, lateral edge of each closure flap 100, 102 are hinge lines each indicatd at 108 from which extend pairs of end strapping flaps 110, 112 and 114, 116, respectively. The side edges of each strapping flap are inclined slightly to correspond to the angular construction on the inclined end wall side edges. Of course, the length dimension of each strapping flap 110, 112, and 114, 116, respectively, will be substantially equal to the vertical height dimension of the container in its erected state. This may be seen clearly when referring to FIG. 4. Located within the opposed hinge lines 108 are additional stacking tab elements each indicated at 118 and cutout portions 120 which together, when the container is in the erected state, will cooperate with stacking tab 64 and cutouts 66. Again this relationship will be clearly seen when referring to FIG. 4. The result will be that when the container is to be stacked one atop another there will be several thicknesses of corrugated paperboard forming four upstanding stacking tabs, two on each end of the container.

Located along the bottom edge, each indicatd at 122 of each strapping flap, is a bendable locking tab each indicated at 124. Each locking tab 124 has three hinge lines to be foldable about two edges and the bottom whereby it can be fitted into the respective cutouts 42 within bottom wall 12. Once each locking tab 124 is inserted through its respective cutout 42, the side edges will be folded outwardly while manipulating the respective tab 40 so the locking relationship is established.

While not essential to the practice of the present invention, since the paperboard material is available when the flat blank sheet is cut and scored, additional supporting flaps may be provided. Extending outwardly from the inside vertical edges of each end strapping flap 110, 112 and 114, 116 are opposed vertical support walls 126, 128 and 130, 132, respectively. Each support wall will extend inwardly only across a relatively short dimension of the erected container but will provide additional vertical strength within the corner sections of the erected container. In order to provide clear cooling vents throughout the structure there will be particular cutouts designated as 134 and 136, respectively, within the support walls so as to be coincident with the respective apertures in side walls 18, 20 and the partial vertical side walls 68, 70 and 72, 74. Each vertical support wall has a rounded corner indicated at 138 which is provided primarily to make erection of the container easier and this will be more fully appreciated by referring to FIG. 3.

Figure 2:
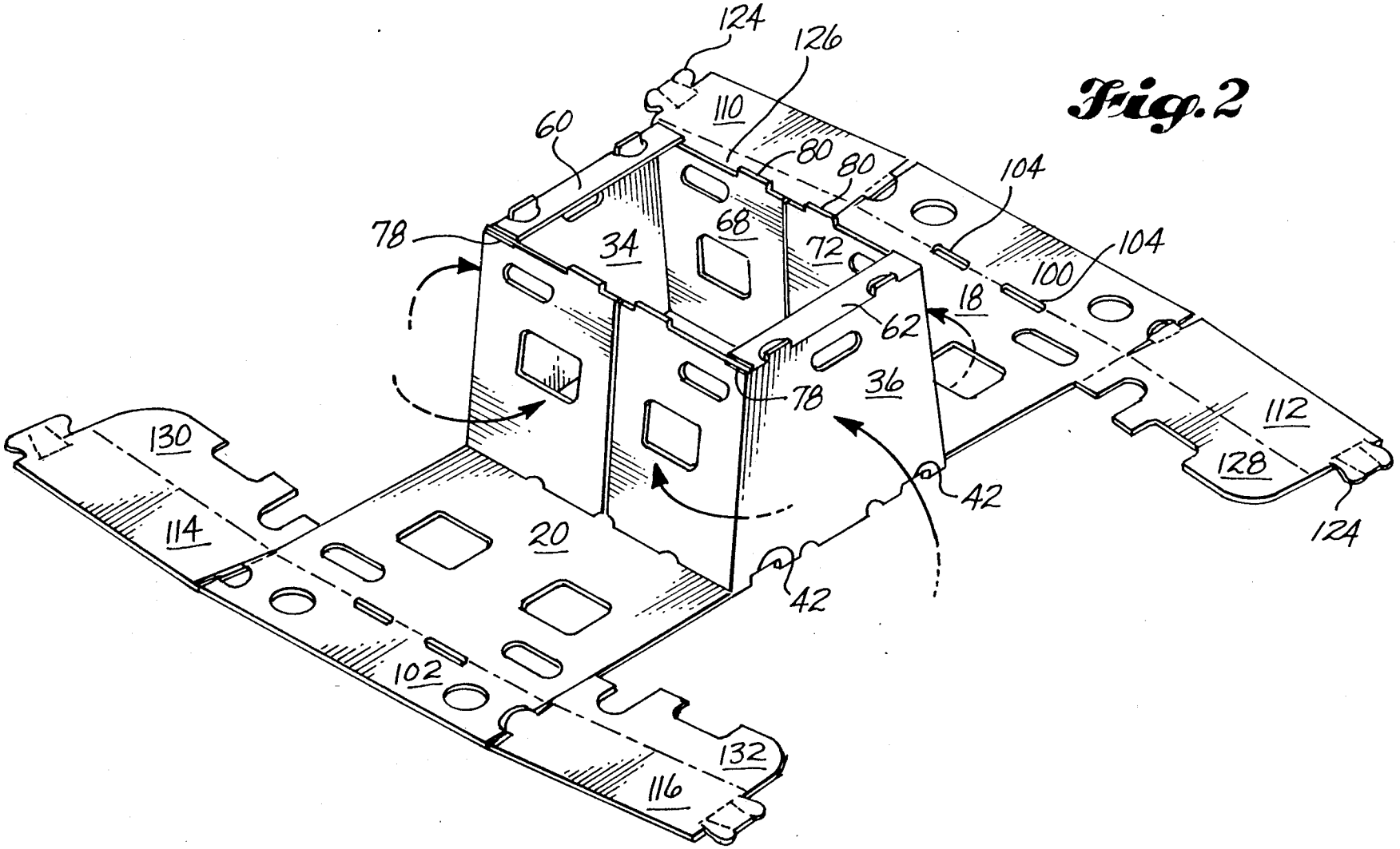
FIG. 2 is a perspective view showing a portion of the erection sequence where the partial vertical side walls are folded into place.
Figure 3:
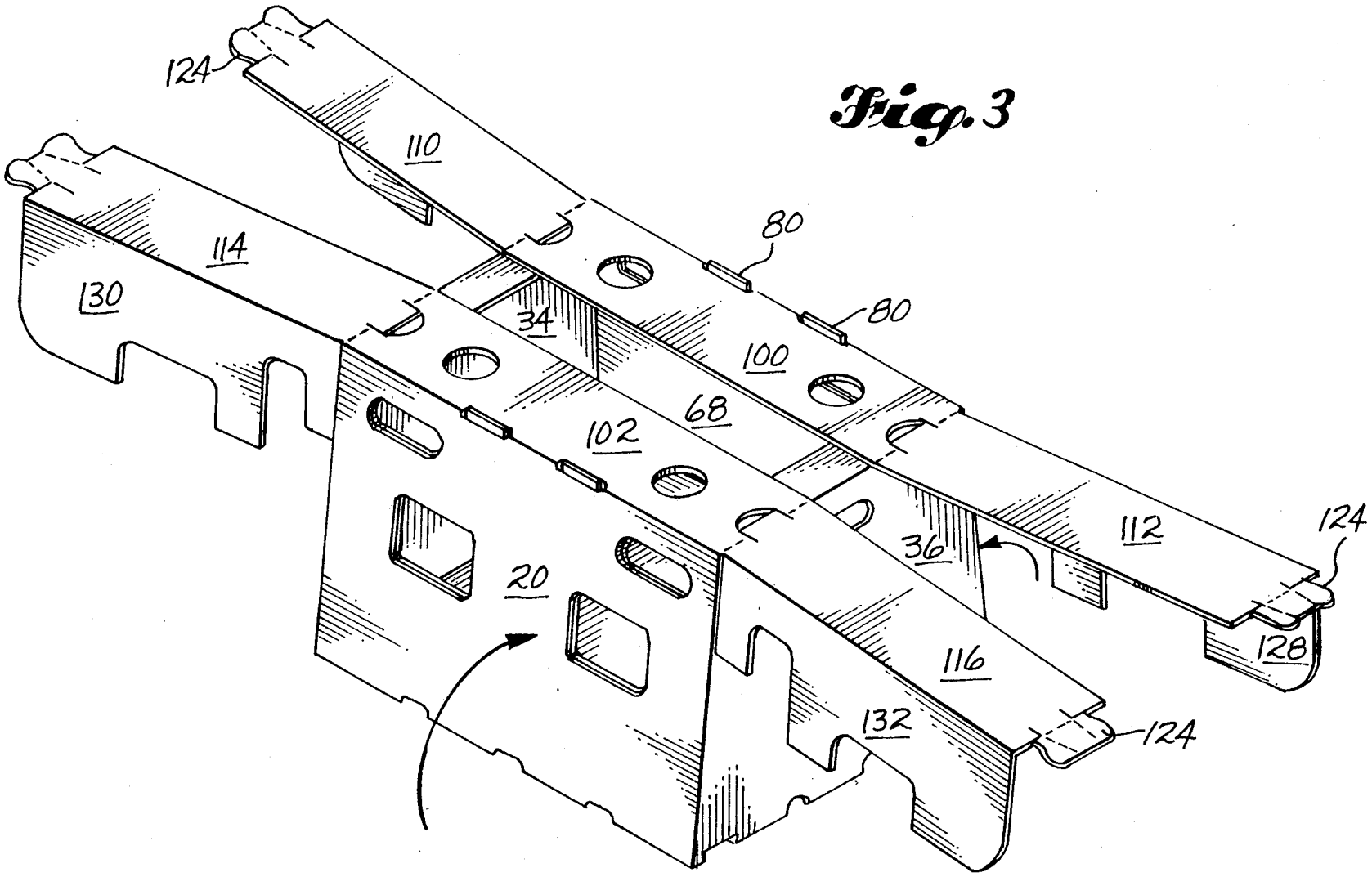
FIG. 3 is a view similar to FIG. 2 showing the exterior side walls being folded upwardly to lie flat against the interior side wall portions.
Figure 4:
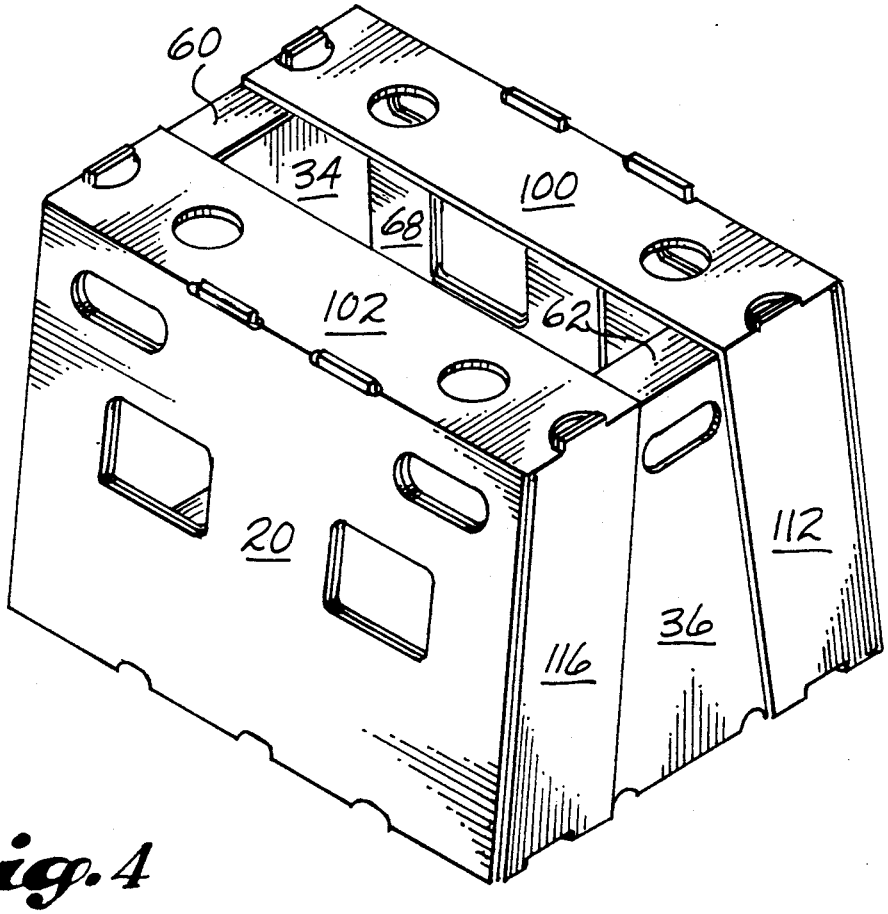
FIG. 4 is a view similar to FIGS. 2 and 3 but shows the completely erected and closed container where the strapping assembly and the respective portions are folded downwardly over the end walls with the locking tabs in place.

Turning now to how the invention is used and erected in the field by a field worker, reference should be made primarily to FIGS. 2-4. Each flat cut and scored blank 10 will be distributed to field workers who are to place the harvested produce within the erectable container. The first step will be to partially form the container into a scoop-like structure. In FIG. 2 the first step will be to fold the end walls 34, 36 upwardly 90° while turning the one pair of opposed partial vertical side walls 68, 72 inwardly so they will be inclined upwardly in a vertical orientation and will meet at approximately the centerline. Each opposed top end cover panel 60, 62 is also folded over 90° to lie flat and each opposed edge will fit within opposed depressions 78. Then one side wall is folded upwardly 90° to overlie the juxtaposed partial vertical side wall 68, 70 in order to form the two-ply side wall construction which will then be in the inclined orientation. To lock the side wall in place the top closure flap 100 will be folded 90° and the locking tabs 80 extended through the corresponding opposed slots 104. In this orientation the top closure flap 100 will be lying horizontally atop the partially erected container and each opposed stacking tab 64 will then be extending upwardly through the respective cutouts 120. Next the end strapping flaps 110, 112 are folded downwardly an angle of 90° to overlie the respective portions of the end walls 34, 36. To lock each strapping flap 110, 112 in place the respective locking tabs 124 wil be manipulated and inserted into cutouts 42 while tab 40 is bent to accommodate the entry of tabs 124. As each strapping flab 110, 112 is folded downwardly if the vertical support walls 126, 128 are provided they will be inserted in the opening between side wall 18 and the then juxtaposed respective partial vertical side walls 68, 72.

This partially erected container then forms a scoop like structure with one side being left open and the partial vertical side wall 72, 74 being left open or at least in a foldable state to allow easy entry of the produce as it is packed by the field packer. While FIGS. 2 and 3 show a uniform symmetrical erection sequence, the preferred sequence is for field erection while leaving one side open so the field worker can have the scoop like structure for packing the fresh cut produce. After the produce is inserted into the partially erected container and the desired quantity loaded the other side of the container will then be erected and locked into place with the same procedure as the first side. The fully erected container is depicted in FIG. 4 showing each of the opposed end strapping flaps 110, 112 and 114, 116 locked in place through the use of the depending locking tabs 124.

Thus, what is provided when the fully erected container is packed with fresh produce such as asparagus or green onions, is a packed produce within a container that has excellent stacking strength, particularly within the corner portions given the multiple layers of corrugated paperboard material and which has sufficient cooling vents to provide adequate air circulation during shipment. In addition, since the bottom of the box is larger than the top given that the side walls are inclined to the vertical, the upwardly extending stacked produce is neatly held in place during packaging and shipment. In addition, a field erectable container is provided which is cut and scored from a single piece of paperboard material and which is erectable into a substantially locked, structurally sound container without the use of any additional staples or straps which was common with prior art containers.

While a detailed description has been provided of the preferred embodiment, it may occur to those skilled in the art to make additional changes and modification which will nevertheless be within the scope of the present invention. All such changes and modifications are intended to be included within the scope of the appended claims.

I claim:

1. A single-piece paperboard container for packing product has a top and a bottom wall together with side walls having upper edges adjacent to the top, in which the bottom of the container has a larger area than the top of the container and wherein the side walls are inclined from the vertical inwardly toward the top, comprising:

a pair of end walls, a strapping assembly extending outwardly from the edge of at least one of said side walls including a plurality of hinged portions one of which is folded over the adjacent end wall and further having a locking tab which is locked into the bottom wall.

* * * * *